United States Patent [19]

Güttinger

[11] 3,989,422

[45] Nov. 2, 1976

[54] DISPLACEMENT MACHINE FOR COMPRESSIBLE MEDIA

[75] Inventor: Heinrich Güttinger, Wettingen, Switzerland

[73] Assignee: Aginfor AG Fur Industrielle Forschung, Baden, Switzerland

[22] Filed: Jan. 29, 1976

[21] Appl. No.: 653,534

[30] Foreign Application Priority Data

Feb. 7, 1975 Switzerland ..... 1541/75

[52] U.S. Cl. ..... 418/55; 418/60

[51] Int. Cl.[2] ..... F04C 17/02

[58] Field of Search ..... 418/54, 55, 56, 57, 418/58, 59, 60

[56] References Cited

UNITED STATES PATENTS

| | | | |
|---|---|---|---|
| 801,182 | 10/1905 | Creux | 418/55 X |
| 1,376,291 | 4/1921 | Rolkerr | 418/55 X |
| 3,011,694 | 12/1961 | Audemar | 418/55 X |
| 3,560,119 | 2/1971 | Busch et al. | 418/55 |
| 3,802,809 | 4/1974 | Vulliez | 418/55 X |

FOREIGN PATENTS OR APPLICATIONS

| | | | |
|---|---|---|---|
| 980,737 | 1/1951 | France | 418/55 |

*Primary Examiner*—C. J. Husar
*Assistant Examiner*—Leonard Smith
*Attorney, Agent, or Firm*—Werner W. Kleeman

[57] ABSTRACT

A displacement machine for compressible media comprising a displacement compartment bounded by an inwardly situated spiral-shaped side wall and an outwardly situated spiral-shaped side wall, the displacement compartment describing a span angle which exceeds 360° and extends from an inlet to an outlet. The displacement compartment is provided with a displacement element which carries out a circulatory movement relative to the displacement compartment and likewise possesses the shape of a spiral and has practically the same span angle as the displacement compartment. The displacement element, during the course of the circulatory movement, always contacts both the outer situated side wall and the inner situated side wall at least at one respective advancing contact line. A pole of a first section, spanning approximately 360° both of the displacement compartment and the displacement element is off set from a pole of a likewise spiral-shaped second section which uniformly merges at the inner end of this first section by an amount which is smaller than the mean radius of curvature at the inner end of the aforementioned first section.

10 Claims, 5 Drawing Figures

DISPLACEMENT MACHINE FOR COMPRESSIBLE MEDIA

BACKGROUND OF THE INVENTION

The present invention relates to a new and improved construction of a displacement machine —also referred to as a positive displacement machine— for compressible media.

Generally speaking, the positive displacement machine of the invention is of the type incorporating a displacement compartment bounded by a spiral-shaped inwardly situated side wall and a spiral-shaped outwardly situated side wall, the displacement compartment describing a span angle exceeding 360° and extending between an inlet and an outlet. Further, there is provided for the displacement compartment a displacement element arranged therein and carrying out a circulatory movement relative thereto, this displacement element likewise possessing the shape of a spiral and having practically the same span angle as the displacement compartment. The displacement element, during the course of the circulatory movement, always contacts both the outer situated side wall and also the inner situated side wall at least at one respective progressing or advancing contact line.

During operation of positive displacement machines of this type there is bounded, on the one hand, by the displacement element and, on the other hand, by the one side wall of the displacment compartment a conveying compartment or chamber which, during the course of the circulatory or gyrating movement migrates along the spiral and accordingly changes its volume. As a result, depending upon whether the migratory movement occurs along the spiral from the outside towards the inside or from the inside towards the outside, there results a compression or expansion, respectively, of the conveyed medium.

An approximation of the compressibility factor or expansion factor, as the case may be, can be derived from the ratio between the mean or average diameter of the section of the spiral of the displacement compartment which spans 360° and following the inlet of the machine and the mean or average diameter of the section of the spiral of the displacement compartment which spans 360° and directly precedes the machine outlet. There is equated to the mean diameters the arithmetic mean between the mean inner diameter of the outer situated side wall of the displacement compartment and the mean outer diameter of the inner situated side wall of the displacement compartment.

The conveying capacity of such machine furthermore is dependent, among other things, upon the spacing between the outer situated side wall and the inner situated side wall which is automatically constant over the entire course of the displacement compartment due to the circulatory movement of the displacement element, i.e. viewed in the conveying direction upon the "width" of the displacement compartment. This spacing or width, on the one hand, corresponds to one-half of the difference between the inner diameter of the outer situated side wall and the outer diameter of the inner situated side wall for a given pole ray and, on the other hand, to the diameter of the circulatory movement.

From these considerations it follows that for a certain machine size there is present a greater compressibility factor or expansion factor at the expense of the conveyed quantity or vice-versa. This is so because for a large compressibility factor or expansion factor the ratio, or stated in a more simple manner, the difference between the mean diameter of the section of the spiral spanning 360° and following the machine inlet and the mean diameter of the section of the spiral spanning 360° preceding the machine outlet, must be chosen to be as large as possible. This difference becomes that much greater the smaller the width of the displacement compartment, i.e. the smaller the possible conveying capacity of the machine.

A state-of-the-art machine which satifies the above considerations has been disclosed, for instance, in FIGS. 14 to 16 of U.S. Pat. No. 801,182. With this machine the spiral spans both the displacement compartment as well as also the displacement element approximately 4 times 360°. The compressibility factor or expansion factor for this machine is estimated to amount to 3. In order to obtain such a conveying compartment between the displacement element and a side wall of the displacement compartment must extend from the machine inlet 4 times completely about the pole of the spiral before it reaches the machine outlet. With the exception of the first complete circulatory movement following the machine inlet and the last complete circulatory movement preceding the machine outlet, the conveyed medium of this prior art machine thus must move through an unnecessarily long path, increasing the spatial requirements of the machine or, with the same size machine, impairing the conveying capacity thereof.

SUMMARY OF THE INVENTION

Hence, it is a primary object of the present invention to provide an improved construction of positive displacement machine of the character described which is not associated with the aforementioned drawbacks and limitations of the prior art proposals.

Another and more specific object of the present invention aims at the provision of a new and improved construction of a machine of the previously mentioned type wherein the compressibility- and expansion-factors which can be realized are considerably less dependent upon the conveying capacity than is the case for the prior art machine.

Now in order to implement these and still further objects of the invention which will become more readily apparent as the description proceeds, the invention proposes a positive displacement machine of the previously mentioned type which, according to the improvement aspects of this development, is characterized by the features that the pole of a first section spanning approximately 360° both of the displacement compartment as well as also of the displacement element is offset from the pole of a second likewise spiral-shaped section which gradually or uniformly merges at the inner end of this first section, by an amount which is smaller than the mean or average radius of curvature at the aforementioned inner end of the first section.

Although the second section uniformly merges with the first section, at the transition between the first section and the second section the curvature of the spiral suddenly drops. In other words, the course of the spiral of the inventive machine can be compared approximately with that curve which would result if there were removed from a spiral having a great number of coils the innermost coil, shifting the same in its plane and tangentially attaching such to the inner end of the first outermost coil.

In this way there is realized a considerable saving in space, or, as such is the situation with a preferred exemplary embodiment, the spiral described by the displacement compartment and the spiral described by the displacement element can possess multiple windings or coils, and the individual coils or windings of the spirals described both by the displacement compartment and also by the displacement element can be angularly shifted or turned with respect to the neighboring coils by an amount corresponding to 360° divided by the number of coils and stacked within one another. With this embodiment it is possible for a certain outer diameter of the machine to increase both the conveying capacity as well as also the compressibility- or expansion-factor to a maximum value, and the diameter of the circulatory movement does not experience any change.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
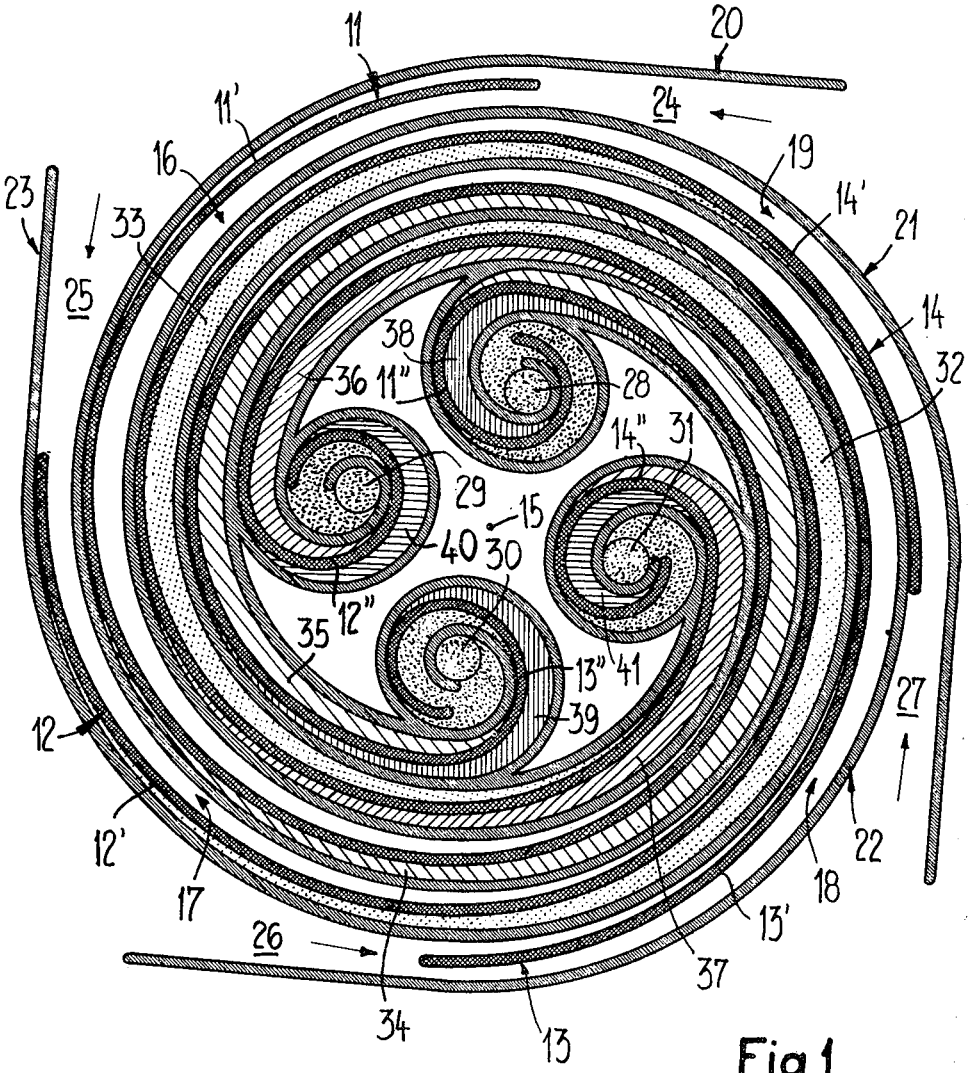
FIG. 1 is a purely schematic sectional view through the essential components of a positive displacement machine wherein the conveying compartments or chambers have applied thereto different shading in order to render clearer the mode of operation of the machine.

Describing now the drawings, in FIG. 1 there is illustrated a positive displacement machine possessing a 4-coil displacement compartment and a likewise 4-coil displacement element. The displacement element consists of four identical displacement vanes 11, 12, 13, 14 which are arranged offset through 90° with respect to one another and engage into one another. The displacement vanes have been provided in the drawing with a crosswise shading in order to more clearly illustrate the same. Each of the displacement vanes 11 to 14 possesses a first section 11′, 12′, 13′, and 14′, respectively, which, as shown in FIG. 1, possessess the shape of a spiral extending about the pole or axis 15 and a span angle of 360°. Uniformly merging at each of the first sections 11′, 12′, 13′, 14′ is a second section 11″, 12″, 13″, and 14″ respectively, which likewise are of spiral-shape, possess a span angle of also approximately 360°, however each extends about an individual pole or axis which has not been particularly referenced.

Each of the displacement vanes 11 to 14 is arranged in a likewise spiral-shaped displacement compartment 16, 17, 18, and 19, respectively, and equipped with additional means (not shown in FIG. 1) in order to carry out a circulatory or gyratory movement within the associated displacement compartment. The displacement compartment 16 is bounded by the inner side or surface of a spiral-shaped wall element 20 and by the outer side or surface of a likewise spiral-shaped wall element 21. The displacement compartment 17 is bounded by the inner side or surface of a spiral-shaped wall element 23 identical to the wall element 20 and by the outer side or surface of the wall element 20. The displacement compartment 18 in turn is bounded or limited by the inner side or surface of a spiral-shaped wall element 22 and by the outside or outer surface of the wall element 23. Finally, the displacement compartment 19 is bounded by the inner side of the wall element 21 and the outer side of the wall element 22. The wall elements 20, 21, 22, 23 are mutually of identical construction and stacked within one another while rotated through 90° relative to one another, similar to the situation for the displacement vanes 11 to 14. Each of the displacement compartments 16 to 19 extends from an associated inlet 24, 25, 26 and 27 to an outlet 28, 29, 30 and 31 respectively. It should be understood that the wall elements 20 to 23 possess a fixed relative position with regard to one another. For instance, they can be secured to a stationary plate. Additionally, it is to be remarked that the radial spacing between the inner side or surface of a wall element and the outer side or surface of the neighboring wall element is constant over the entire course of the spiral, that is to say, both sections are constant. An exception to this rule is constituted only by the inlet-side extension of the wall elements which should facilitate the inflow of the medium to be conveyed.

If there is imagined that the displacement vanes 11 to 14 in the illustrated arrangement carry out a circulatory or gyrating movement, for instance in the counterclockwise direction then it will be seen that the contact points of the outer side of the displacement vanes with the inner surface of the outer situated wall element of the relevant displacement compartment and the contact points between the inner surface of the displacement vanes with the outer surface of the inner situated side wall of the associated displacement compartment migrate inwardly along the spiral, this being the case both for the first section as well as also the second section of the spiral which merges at the first section. By means of two contact points which follow one another at the same side of the displacement vane there is bounded in the relevant displacement compartment a conveying compartment or chamber which during the gyrating or circulatory movement, likewise migrates inwardly along the spiral.

Several of such closed conveying chambers have been shown in FIG. 1 with special shading in order to distinguish the same. Thus, in the displacement compartment 17 and in the displacement compartment 19 there have been indicated with a uniform point-shading a respective substantially sickle-shaped, closed conveying chamber 32 and 33, respectively, and by means of slanted shading extending from the upper left downwardly towards the right there has been portrayed in the displacement compartments 16 and 18 a respective sickle-shaped, closed conveying chamber 34 and 35. Moreover, in FIG. 1 there has been portrayed by means of slanted shading extending from the upper right towards the bottom left in the displacement compartments 17 and 18 a respective further closed sickle-shaped conveying chamber 36 and 37, respectively, and by means of shading extending from the top towards the bottom there has been shown in the displacement compartment 16 and 18 a respective further closed conveying chamber 38 and 39, respectively, and by means of horizontal shading there has been shown in the displacement compartments 17 and 19 a respective further closed conveying chamber 40 and 41 respectively. By means of a non-uniform point shading there are indicated the conveying chambers at the end of the displacement compartments 16 to 19 and which are open in the direction of the outlets 28 to 31. The volume of the conveying chambers designated with the same shading is approximately the same. On the other hand, there will be seen that the volume of the conveying chambers becomes smaller the closer such are located at the inner end of the spiral. In particular, the reduction in the volume of the conveying chambers is sudden during the transition from the first sections 11' to 14' to the second sections 11'' to 14'' of the displacement vanes 11 to 14. The conveying chambers open towards the machine inlets 24 to 27, i.e. in the process of being formed and not yet generating a positive displacement, have not been shaded. The conveying chambers 40 and 41 which are indicated with horizontal shading possess approximately 5 times less volume than the conveying chambers 32 and 33 provided with the uniform point shading. Consequently, the compressibility factor of the machine, assuming that the displacement vanes 11 to 14 circulate in the counterclockwise direction, amounts to approximately 5, whereby, however, the conveyed medium between the inlet and outlet has only moved through approximately two circulatory or gyrating motions, each extending through 360°. The conveying capacity of the machine illustrated in FIG. 1 is composed of the conveying capacity in each of the displacement compartments 16 to 19. As a practical matter, one is concerned with four displacement machines arranged stacked within one another, however connected in parallel. Upon charging of the outlets 28 to 31 with a compressible medium which is pressurized it will be recognized that the displacement vane 14 is induced to carry out a gyrating or circulatory movement in the clockwise direction, the conveying chambers then migrating along the spiral towards the outside and thus bring about an expansion of the medium delivered under pressure.

Figure 2:
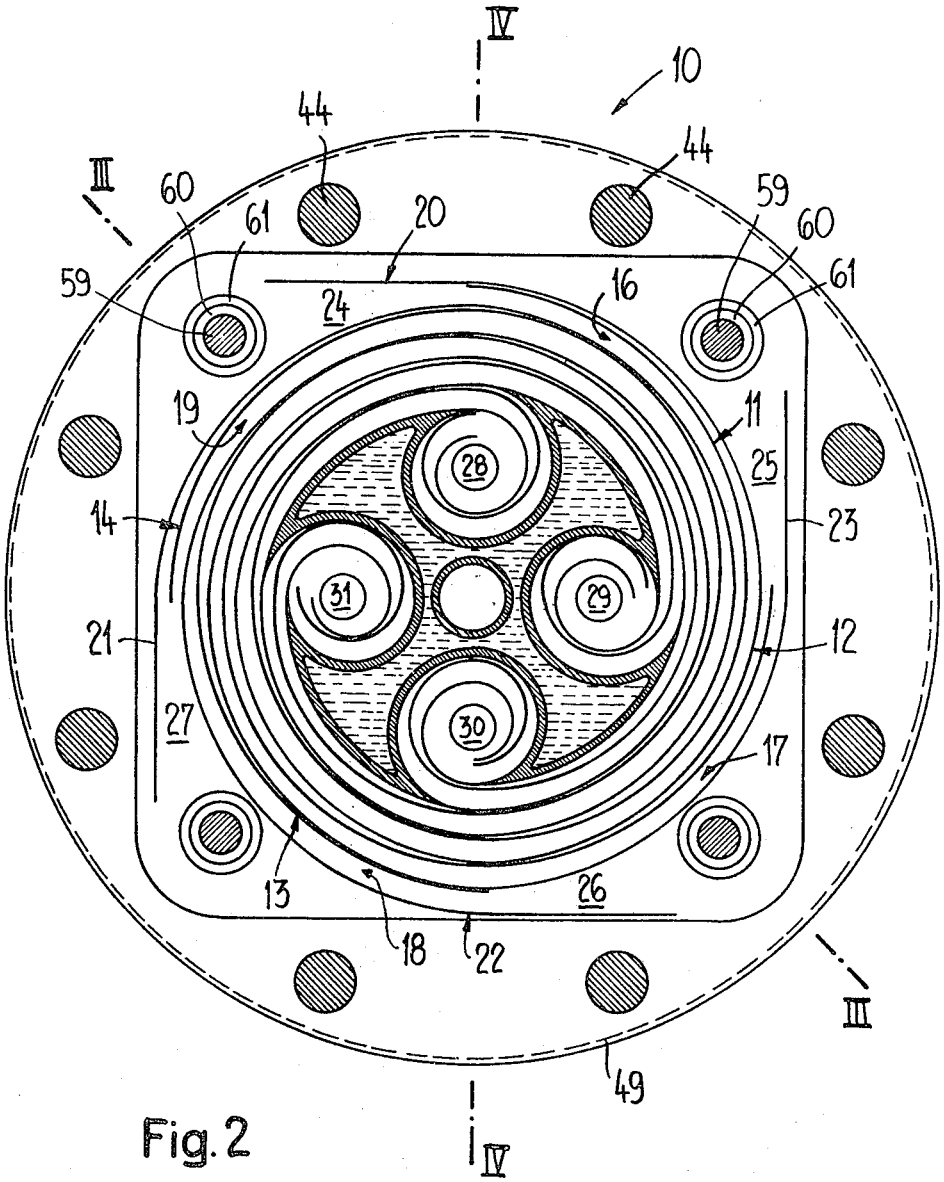
FIG. 2 is a schematic sectional view of a positive displacement machine which approximately corresponds to the schematic showing of FIG. 1, however has been illustrated as the mirror-image thereof.
Figure 3:
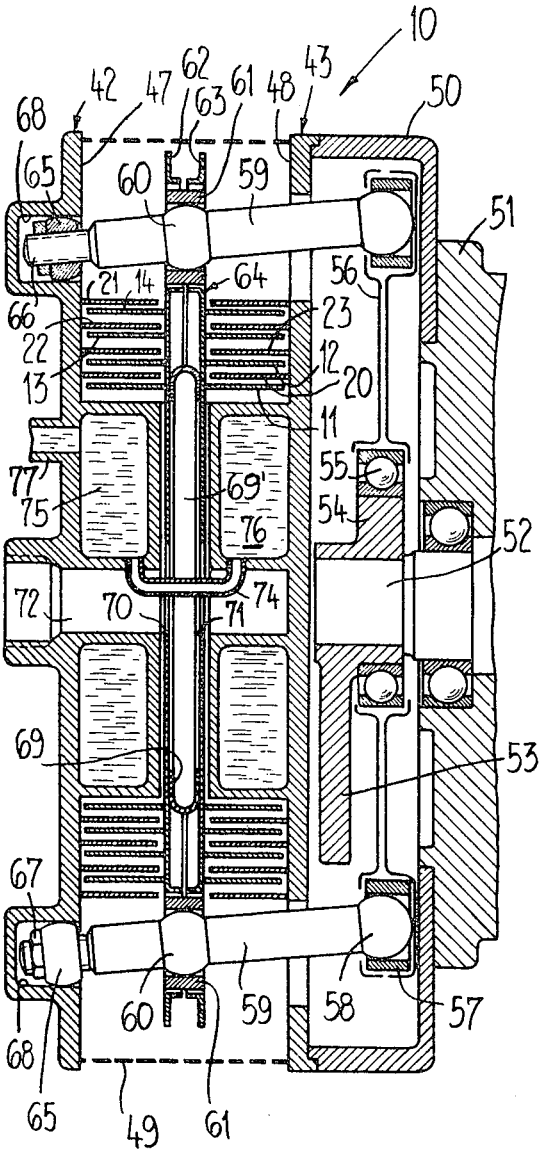
FIG. 3 is a sectional view along the line III—III of FIG. 2.
Figure 4:
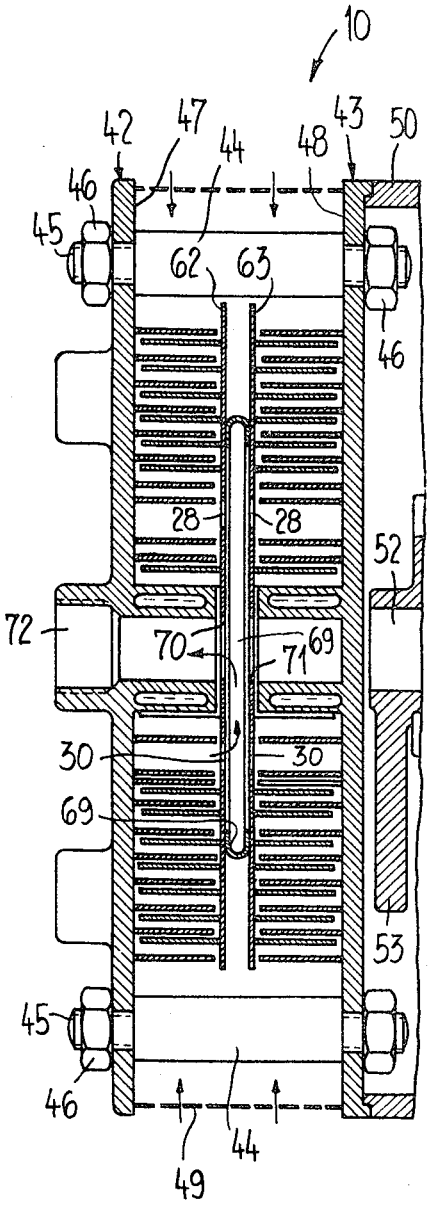
FIG. 4 is a sectional view along the line IV—IV of FIG. 2.

In FIGS. 2 to 4 there is illustrated a constructional manifestation of the machine which has been described in principle in conjunction with FIG. 1. There will be seen from the showing of FIG. 2 in principle the arrangement of FIG. 1, but portrayed in mirror image, wherein for purposes of improving clarity the displacement vanes 11 to 14 and the wall elements 20 to 23 have only been shown as full lines. As will be recognized from FIG. 3 the illustrated positive displacement machine 10 possesses a housing composed of two components or parts 42 and 43. Both of the parts 42 and 43 are secured to one another at a fixed spacing by means of spacer elements 44, bolts 45 and nuts 46 in such a manner that the confronting flat faces or sides 47 and 48 of both housing parts 42 and 43 possessing a circular outer configuration are parallel to one another. Both at the flat side or face 47 as well as also at the flat side or face 48 there is secured a respective set of wall elements 21 to 23. The intermediate space between the housing parts 42 and 43 is bridged at their periphery by a wire mesh or netting 49 or the like only indicated schematically, and which at the same time serves as an inlet filter.

At the side of the housing part 43 facing away from the housing part 42 there is flanged to such housing part 43 a drive box 50 at which in turn there is directly flanged a drive motor 51. At the power-take off shaft 52 of the drive motor 51 there is rigidly seated for rotation an eccentric body 54 which is equipped with a counterweight 53 and upon which eccentric body there is rotatably mounted, by means of a ball bearing 55, a schematically indicated drive disk or plate 56. The drive disk or plate 56 is provided in uniform spaced relationship about the periphery thereof with a number of ball sockets 57, here for instance amounting to four such ball sockets in each of which there is rotatably mounted the one spherical end 58 of a respective wobble rod 59. The central region of each of these wobble rods 59 possesses a substantially spherical segment-shaped collar 60 which is mounted practically without any radial play to be rotatable and capable of wobbling in an associated bearing sleeve or bushing 61. Each bushing 61 is inserted in oppositely situated punched-out openings of two mirror-image constructed sheet metal components which collectively form a plate-shaped double-wall body 64 which, in the embodiment under discussion, can be designated as a rotor body. The end of each wobble rod 59 situated opposite the spherical end 58 is provided with external threading 66 at which there is threadably connected a likewise substantially spherical segment-shaped bearing body 65 secured by means of a nut member 67 or equivalent structure. The bearing bodies 65 are mounted to be rotatable and capable of wobbling in a respective bearing bore 68 formed at the housing part 42. From what has been discussed above it will be recognized that during rotational movement of the power take-off shaft 52, due to the action of the wobble rods 59, the rotor body 64 is caused to carry out a gyrating or circulatory, but non-rotating movement, the radius of this circulatory movement can be accommodated to the spacing between the wall elements 20 to 23 by adjusting the bearing bodies 65 upon their outer threading 66.

Both of the metallic or sheet metal parts 62 and 63 forming the rotor body 64 are exposed to the action of a substantially ring-shaped spring element 69 or the like which strives to displace both of the sheet metal parts 62 and 63 away from one another. At the sides confronting the flat sides 47 and 48 of both housing parts 42 and 43 the sheet metal parts 62 and 63 carry a respective set of displacement vanes 11 to 14 which engage between the wall elements 20 to 23 secured to the corresponding housing parts. In the sheet metal parts 62 and 63 there are formed the outlet openings 28 to 30 which initially extend into the intermediate compartment or space 69' between both of the sheet metal parts. Additionally, the sheet metal parts 62 and 63 further possess a respective central throughpassing opening 70, 71 which, notwithstanding the circulating movement which they carry out, always are in flow communication with an outlet stud or connection 72 formed at the housing part or portion 42.

It is to be observed that in reality the wall elements 20 to 21 contact by means of their side edges which are opposite the flat sides 47, 48 respectively, the confronting sides of the sheet metal parts 62 and 63 respectively, and, on the other hand, that the displacement vanes 11 to 14 contact in each case the flat sides 47 and 48 by means of their side edges which are located opposite the sheet metal elements 62 and 63, respectively, although in the drawing there has been shown a considerable amount of play between such side edges. This play has only been shown in the drawings so as to make clear which elements bears at which element. The compensation for manufacturing tolerances in the width of the wall elements and displacement vanes as well as possible errors in the parallelism of both housing parts 42 and 43 is undertaken by means of the spring element 69 which has the tendency of displacing both sheet metal parts 62 and 63 away from one another.

Finally, there are formed at the housing parts 42 and 43 cooling chambers 75 and 76 in the space which is left free by the inner sections of the displacement vanes and the displacement compartments. These cooling chambers are connected with one another via a connection conduit 74 and can be connected with a cooling circulation system by means of a connection conduit 77. The cooling in particular of the inner sections of the displacement compartments then can be desirable if the conveyed medium, in the case of operation of the machine as a compressor only should have an inconsequential higher outlet temperature than the inlet temperature.

During operation of the machine described in conjunction with FIGS. 2 to 4 the rotor body 64, as already mentioned, and with it both sets of displacement vanes 11 to 14, carry out a purely circulatory or gyrating movement in the space between both of the housing parts 42 and 43, and specifically in the displacement compartments bounded by the wall elements 20 to 23. Rotation of the rotor body 64 about its own axis is not possible since it is supported at four identical wobble bolts, which, while capable of wobbling, can not carry out any revolving movement. If the machine is operated as compressor, then it sucks-up the medium to be conveyed, through the wire mesh or netting 49 functioning as a filter, in the direction of the arrows indicated in FIG. 4 and expels such through the outlet stud or connection 72 in the direction of the arrow shown in FIG. 3. The compressibility factor of the machine illustrated in FIGS. 2 to 4 amounts to approximately 5 and the conveying capacity or delivery extensively depends upon the rotational speed of the motor 51. In any event, the conveying capacity per revolution of the displacement vanes for each of both parallel connected sides of the machine of FIGS. 2 to 3 amounts to approximately 8 times the volume of the conveying chamber 32 or 33 which has been designated in FIG. 1 with a uniform point shading. Further, it is to be remarked that the relative velocity of the moved parts with respect to one another is rather inappreciable owing to the comparatively small diameter of the circulatory movement.

Figure 5:
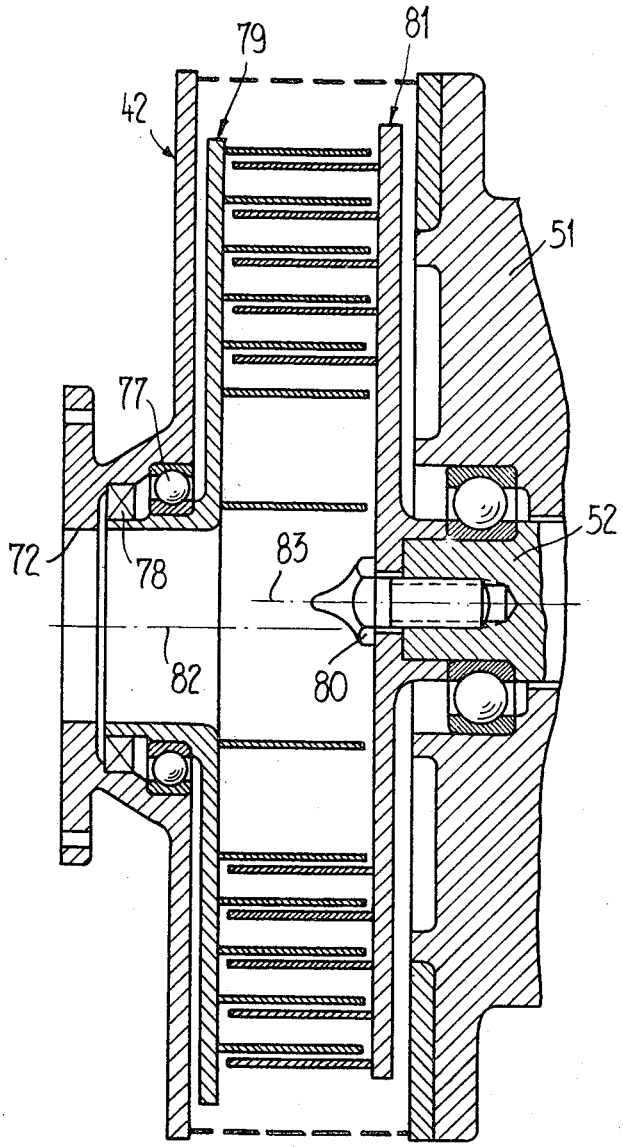
FIG. 5 is a sectional view through a variant embodiment of the invention.

While with the machine of FIGS. 2 to 4 the wall elements 20 to 23 limiting the displacement compartments are stationarily arranged, with the embodiment of FIG. 5 such wall elements (not particularly designated in FIG. 5 with reference characters) have been secured at a plate 79 rotatably mounted in housing part 42 by means of a ball bearing 77 and sealed relative to the outlet stud or connection 72 by means of a seal. Also the displacement vanes, which again in FIG. 5 have not been particularly designated by a reference character, are secured to a plate 81 which is fixedly clamped for rotation upon power-take off shaft 52 by means of a bolt 80 or equivalent structure. The axis of rotation 82 of the plate 79 and the axis of rotation 83 of the plate 81 extend parallel to one another, but such axes are offset with respect to one another so that during rotation of the plate 81 the plate 79 is entrained with the same rotational speed for the purpose of carrying out a unidirectional rotational movement, however carries out a circulatory movement with regard to the plate 81.

The considerably simpler construction of FIG. 5 is particularly suitable for blowers having a comparatively low compressibility factor. The compressibility factor can be simply reduced in that the span angle of the second section of the displacement vane which follows the first section i.e. that section wherein the pole of the spiral if offset with respect to the pole of the first section, is selected to be less. In particular, the constructional manifestation of FIG. 5, especially with suitable selection of the materials for the wall elements, the displacement vanes and the plates 79 and 81, manifests itself by its especially quiet running characteristics.

While there is shown and described present preferred embodiments of the invention, it is to be distinctly understood that the invention is not limited thereto, but may be variously embodied and practiced within the scope of the following claims. Accordingly,

What is claimed is:

1. A positive displacement machine for compressible media, comprising a displacement compartment bounded by an inner situated substantially spiral-shaped side wall and an outer situated substantially spiral-shaped side wall, said displacement compartment describing a span angle which exceeds 360° and extending between an inlet and an outlet, a displacement element arranged in the displacement compartment for carrying out a circulatory movement relative to the displacement compartment, said displacement element substantially possessing the shape of a spiral and having practically the same span angle as the displacement compartment, the displacement element during the course of the circulatory movement always contacting both the outer situated side wall and the inner situated side wall at least at one respective advancing contact line, the pole of a first section spanning thru about 360° of both the displacement compartment and the displacement element is offset from the pole of a second section which uniformly merges at the inner end of the first section, by an amount which is smaller than the mean radius of curvature at the inner end of said first section.

2. The machine as described in claim 1, wherein both the spiral described by the displacement compartment and the spiral described by the displacement element have multiple coils, the individual coils of the spirals described both by the displacement compartment and the displacement element with respect to neighboring coils are arranged stacked within one another and angularly rotated through an angle amounting to 360° divided by the number of coils.

3. The machine as described in claim 2, wherein both the inner situated side wall and the outer situated side wall are formed by a band element wound in substantially spiral-shape in accordance with the shape of the coil of the displacement compartment limited thereby, and said band element at one side bounding the inner situated side wall of a coil and with its other side the outer situated side wall of the neighboring coil.

4. The machine as defined in claim 2, wherein the displacement element is formed of a number of bands corresponding to the number of its coils and wound in accordance with the form of the associated coil, a plate-shaped component, said bands being secured with their one side edge at one face of said plate-shaped component, means for mounting said plate-shaped component for carrying out a circulatory movement with respect to the displacement compartment.

5. The machine as defined in claim 3, wherein the walls limiting the coils of the displacement compartment are secured at their one side edge at a plate.

6. The machine as defined in claim 5, said mounting means including means for rotatably mounting the plate-shaped component about a first axis of rotation, and means for mounting the plate about a second axis of rotation parallel to the first axis of rotation but offset by an amount corresponding to the radius of the circulatory movement.

7. The machine as defined in claim 4, wherein a respective set of bands forming the displacement element is secured at each face of the plate-shaped component.

8. The machine as defined in claim 7, wherein the plate-shaped component comprises a double-wall sheet metal part, both walls of which are held in spaced relationship from one another by means of a snugly contacting substantially ring-shaped element and an outlet of each coil of the displacement compartment opens into an intermediate space within the ring-shaped element and between said both walls, and said intermediate space communicating with the outlet of the machine.

9. The machine as defined in claim 8, wherein the ring-shaped element is a resilient member which strives to force the walls of the sheet metal part away from one another.

10. A positive displacement machine for a fluid medium, comprising means defining a housing having an inlet and an outlet, means providing a displacement compartment extending between said inlet and said outlet, said displacement compartment extending about an axis defining a first pole through a span angle greater than 360°, said means defining said displacement compartment comprising an inner situated substantially spiral-shaped wall and an outer situated substantially spiral-shaped wall, a displacement element arranged within the displacement compartment for carrying out a gyrating movement relative to the displacement compartment, said displacement element possessing a substantially spiral-shape and possessing essentially the same span angle as the displacement compartment, said displacement element, during the course of the gyrating movement, contacting both the outer situated wall and the inner situated wall at least at one respective progressive contact line, the displacement compartment and the displacement element each having a first section spanning an angle of approximately 360° about said first pole, each said displacement compartment and said displacement element having a second section merging at an inner end of the respective first section thereof and angularly spanning about a second pole, said first pole being offset from the second pole by an amount which is less than the average radius of curvature at the inner end of each said first section.

* * * * *